United States Patent [19]

Schiavone

[11] Patent Number: 4,753,184

[45] Date of Patent: Jun. 28, 1988

[54] HULL WITH CONVEXLY DOWN-STEP PLANE

[76] Inventor: Steven M. Schiavone, 2810 Hargrave St., Philadelphia, Pa. 19136

[21] Appl. No.: 880,083

[22] Filed: Jun. 30, 1986

Related U.S. Application Data

[63] Continuation-in-part of Ser. No. 281,577, Jul. 17, 1981, abandoned, which is a continuation-in-part of Ser. No. 922,265, Jul. 6, 1978, abandoned.

[51] Int. Cl.[4] ..... B63B 1/20

[52] U.S. Cl. ..... 114/56; 114/271; 114/291

[58] Field of Search ..... 114/56, 63, 271, 288–291, 114/67 R, 67 A; 440/71, 66, 69; D12/300, 310–312, 313, 314

[56] References Cited

U.S. PATENT DOCUMENTS

| | | | |
|---|---|---|---|
| 647,591 | 4/1900 | Williams | 114/56 |
| 1,729,446 | 9/1929 | Maier | 114/56 |
| 3,439,643 | 4/1969 | Andrea | 114/63 |
| 3,763,810 | 10/1973 | Payne | 114/291 X |

*Primary Examiner*—Sherman D. Basinger

[57] ABSTRACT

A hull with a convexly down-stepped plane located in the aft section and a "V" shaped hull structure in the forward section. The "V" shaped section and the planar section are connected by a smooth, convexly shaped transition section that is convex in reference to the exterior of the hull and extends below the "V" section. The transition section can be provided with spray root deflectors. The planing surface extends substantially the full width of the lower portion of the hull and can have portions of its after portion upwardly displaced.

21 Claims, 3 Drawing Sheets

HULL WITH CONVEXLY DOWN-STEP PLANE

CROSS REFERENCE TO RELATED APPLICATIONS

This application is a continuation-in-part of Ser. No. 281,577, filed July 17, 1981, entitled "HULL WITH CONVEXLY DOWN-STEP PLANE", by Steven M. Schiavone, which is a continuation-in-part of Ser. No. 922,265, filed on July 6, 1978, entitled "HULL WITH CONVEXLY DOWN-STEP PLANE", by Steven M. Schiavone. All of the related applications are now abandoned.

BACKGROUND OF THE INVENTION

This invention is directed to a hull for boats, ships and the like. More particularly, the present invention is directed to a hull for watercraft which has a V-shaped foreward section and a substantially planar aft section connected by a transition section that is convexly shaped in reference to the exterior of the hull. This application includes improvements to application Ser. No. 281,577 which are the result of practical design exercises. The improvement is to displace a section or sections of the aft portion of the substantially planar section upwards, leaving a some portion of the aft portion of the substantially planar section intact all the way to the stern. This improvement provides a more desirable distribution of the dynamic lifting forces and reduces resistance at planing speeds. This configuration of upwardly displaced or cut-away sections tends to move the center of lift foreward. This is often more desirable than an upward displacement of the substantially planar surface across its entire width because there is more lateral stability. It is also more desirable than transverse steps in many situations because transverse steps are difficult to balance over a wide range of speeds and planing angles and they tend to move the center of dynamic lift aft.

SUMMARY OF THE INVENTION

The present invention is directed to a hull for watercraft which has a lower water engaging surface terminated at one end by a bow and at the other end by a stern. Starting at the bow and extending along a major portion of the hull in the direction of the stern, the hull is shows a V-shaped cross-section. To facilitate the use of lower horsepower-to-weight ratios, the V-section may extend along only a substantial portion of the length of the hull. This would allow a proportionately longer planing surface to provide more lift. The V-shaped section has an apex running longitudinally along the hull and is centered with respect to the width of the hull. The apex is of substantially constant depth for a substantial portion of the length of the V-shaped section. A substantially planar surface is provided in the aft portion of the hull. The planar surface extends essentially the full width of the lower section of the hull. The lower sectionof the hull is essentially the lower third of the hull, not including keels. The planar surface is down-stepped from the apex of the V-section. Down-stepped means that the planar surface extends deeper into the water. The V-shaped section and the planar section are connected by a smooth transition section that is convexly shaped in reference to the exterior of the hull. The convexity is longintudinal, though transverse convexity may also be added. The transition section has less average slope in cross-section view than the hull sides at the transition section. Average slope is defined as the sum of the slope of all tangents to a given curve divided by the length of the curve, where only the absolute value of the the slope of the tangents is considered and infinite slope is allowed. Qualitatively, the hull sides are more vertical than the transition section and the transition section is more horizontal than the hull sides in cross-section view. The transition section is a bottom surface and extends between the chines. The term "chine" refers to primary chines as opposed to secondary chines that are used to increase interior volume, reduce wetted surface, knock down spray, or simulate soft chines. The term primary chine refers to the lower most chine. The chines of convexly down-step hulls originate foreward of the substantially planar surface, above the apex of the of the foreward section showing a "V"-shape. The chines are disposed downward in the the direction of the stern, extending below the apex of the section showing a "V"-shape.

The "V"-shaped section is best understood if its longitudinal apex is viewed in terms of its sternward portion and its foreward portion. Each portion extends along approximately half or 50% of the length of the "V"-shaped section. Considering the hull in profile view, the sternward portion of the apex is essentially straight. The foreward portion of the apex has more average slope than the sternward portion of the apex, relative to the sternward portion of the apex. Average slope has been defined above. The phrase "relative to the sternward portion of the apex" means that sternward portion of the apex is the horizontal frame of reference against which the slope is to be measured. In more general terms, the sternward portion of the apex is essential straight and the foreward portion of the apex is at an angle for some arbitrary portion of its length, being inclined relative to the rearward portion of the apex.

The convexly down-stepper planar section enables an increase in the attainable speed of watercraft in an extremely simple manner. The downward disposition of the planing section enables the lifting of a large portion of the craft out of the water, thereby reducing frictional resistance. Hulls built in accordance with this structure will be able to operate at low trim angles without significantly wetted surface. The convexly down-step hull will thus reduce power requirements and fuel consumption.

The convexly down-step hull enables the use of an efficient flat planing surface for roughwater operation. This is due to the wave cutting action of the foreward V-section and the ability of the hull to operate at low trim angles without significantly increasing wetted surface. The Sea Knife is another concept that enables the use of a flat planing surface for operation in rough water. However, the Sea Knife does have a down-stepped planing surface that is connected to a foreward "V"-shaped section by an outwardly convex transiton section. The outwardly convex transition section directs water flow down to the planar surface. This structure promotes hydroplaning better than a Sea Knife and will thus require less power to overcome the planing hump. The combination of a a foreward "V"-section connected to a down-stepped planing surface by an outwardly convex transition section enables the hull to run at reduced trim angles, reduced resistance and provide more uesable space as compared with the Sea Knife.

The flat submerged planing surface will also provide greater stability at rest.

In one embodiment of the invention, narrow longitudinally extending members project from the bottom of the planing section essentially parallel to the centerline of the hull. In a preferred embodiment, one would extend along the right edge of the planing section and another along the left side. These members act as keels or skegs to increase directional stability.

In another embodiment of the invention, the transition section is provided with spray root deflection means. Spray deflection means on the transition section allow the hull to operate more efficiently at low trim angles and allows a more subtle curve in the tranition section. The spray root deflection means can be a strip of material, preferably wedge shaped, extending across the breadth of the transition section, or it could be in the form of a discontinuity integral to the hull structure. The spray root deflection means can can also be an air blowing system. In this embodiment air is blown at the spray root through a slot(s) or through nozzles in the transition section. In another embodiment an air-tight, flexible material attached to the transition section can be inflated to deflect the spray root. When deflated, this spray root deflector contributes comparitively little resistance at low speeds.

In another embodiment the substantially planar surface may be upwardly displaced or cut-away in a section(s) of its aft portion. This embodiment increases efficiency because the foreward portion of the planing surface provides more lift per unit area than the after portion. By upwardly displacing, or cutting-away a section or sections of the after portion of the substantially planar surface, the resistance is reduced without reducing dynamic lift by a proportionate ammount. The relatively small reduction in lift can be restored by increasing the downward inclination of the substantially planar surface. The shape of the cut-away section(s) depends mainly on the propulsion system. A propulsion system using regular, submerged propellers would probably be more efficient if the propeller(s) was located under the planar surface. A propulsion system using a surface-piercing propeller(s) would probably be more efficient if the propeller(s) was located under a cut-away portion. The number of propellers will also affect the shape of the cut-away portion. The substantially planar surface should be cut-away in a manner that causes water to break at the begining of the cut-away portion. In other words, there should be a hard angle along the edges where the planing surface is cut-away. At planing speeds, this prevents water contact on the upwardly displaced or cut-away sections, thus reducing drag. By retaining some portion of the planing surface all the way to stern, or not cutting away the entire aft portion of the planing surface, a reasonable compromise is made between reduced resistance and lateral stability.

Other features may be incorporated into the hull, such as a cavity or tunnel to house the propeller. Furthermore, the plaing surface need not be completely flat but can be somewhat "V"-shaped, and planing strakes may be used to enhance the planing ability of such a planing surface. The planing surface may utilize air lubrication and cushioning. The air may be contained by skirts, keel members along the sides of the planing surface or any combination of these embodiments.

BRIEF DESCRIPTION OF THE DRAWINGS

For the purpose of illustrating the invention, there is shown in the drawings forms which are presently preferred; it being understood that this invention is not limited to the precise arrangements and instrumentalities shown.

DETAILED DESCRIPTION OF THE PREFERRED EMBODIMENTS

Figure 1:
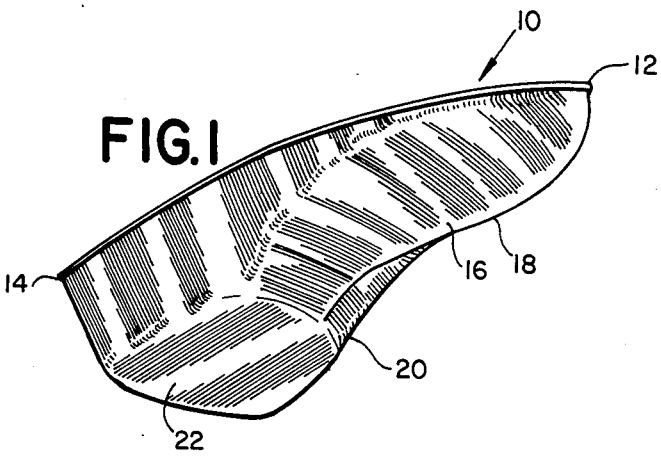
FIG. 1 is a view in perspective of a hull in accordance with the present invention.
Figure 2:
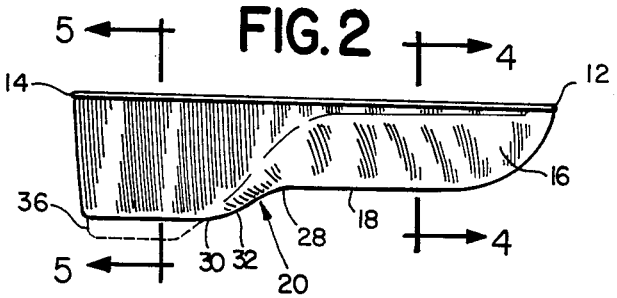
FIG. 2 is a side elevation view of a hull in accordance with the present invention, and also shows in dotted outline a modification of the hull as shown in FIG. 6.
Figure 4:
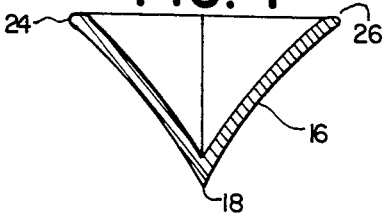
FIG. 4 is a cross sectional view taken along line 4—4 of FIG. 2.
Figure 3:
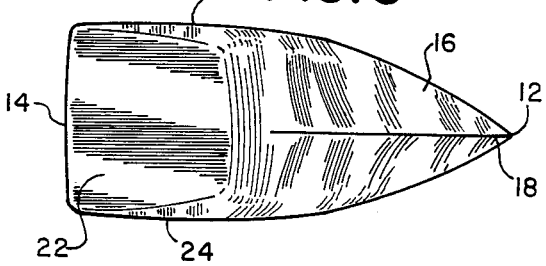
FIG. 3 is a bottom view of the hull in accordance with the present invention.
Figure 5:
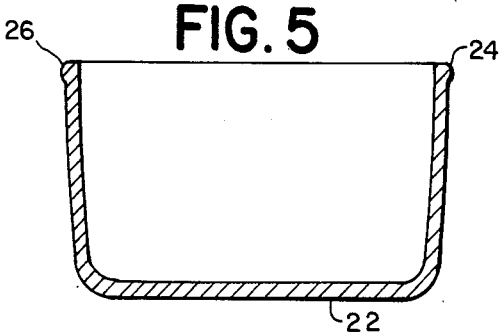
FIG. 5 is a cross sectional view taken along line 5—5 of FIG. 2.

Referring now to the drawings, where like numerals indicate like elements, there is shown in FIG. 1 a perspective view of a hull in accordance with the present invention. The hull 10 may be used on any type of watercraft. Hull 10 is provided with a bow 12 and a stern 14. The inventive shape of the present invention may be best understood by considering FIGS. 1, 2, 3, 4 and 5 together. The foreward portion of the hull shows a "V"-shape in cross-section 16 as can be most clearly seen in FIG. 4. The portion showing a "V"-shape has a longitudinally running apex 18 which is centered with respect to the width of the hull. In other words the apex 18 is formed half way between left side 24 and right side 26 of the hull. The section showing a "V"-shape extends from the bow 12 along a major portion of the length of the hull. Preferrably, the section showing a "V"-shape extends over 50% to about 70% of the length of the hull. However, to facilitate lower horsepower-to-weight ratios, to section showing a "V"-shape may be limited to about one third of the length of the hull. Preferrably, the section showing a "V"-shape is of substantially constant depth for a major portion of its length. The precise shape that the "V" takes, interms of degree of convexity or concavity and degree of sharpness or blountness, depends on the requirements of specific applications.

The rearward end of the section showing a "V"-shape 16 terminates in a preferrably smooth transition section that is convexly shaped in reference to the exterior of the hull. Transition section 20 extends from the rear end of the section showing a "V"-shape 28 to the foreward end 30 of planing surface 22. The transition section 20 near the forward end 20 of the planing surface 22 is the convex down-step.

The bottom of the rearward potion of the hull is a substantially planar surface 22 extending substantially the full width of the lower sectoin of the hull, where the lower section is defined as the lower third of the height of the hull not including keels or skegs, or the portion of the hull below secondary chines. Planing surface 22 extends about 30% to 50% of the length of the hull, but may be extended to about two thirds of the length of the hull for applications that require relatively lower horsepower-to-weight ratios.

Figure 6:
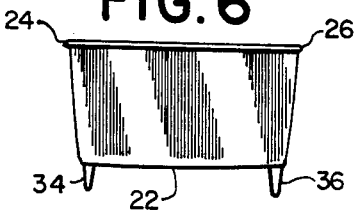
FIG. 6 is a rear elevation view of a hull in accordance with the present invention, and also shows downwardly extending members.

Another embodiment of the invention is shown in FIG. 6 in which the planing surface is provided with atleast one, but preferably a pair of longitudinal downwardly extending members 34 and 36. The longitudinal downwardly extending members may extend substantially the full length of the planing section 22 as shown in dotted lines in FIG. 2. The members 34 and 36 may have rearwardly and downwardly extending foreward edges to reduce resistance. Members 34 and 36 act as keels or skegs to increase directional stability but may also be used to trap air under the planing section. Preferrably, members 34 and 36 are positioned at the far sides of the planing section as shown in FIG. 6 anb are essentially parallel to the centerline of the hull.

In use, a major potion of the loading will be positioned planing surface 22. In a loaded condition, apex 18 will be at least patiallly submerged when the hull is at rest. In the planing mode, the hull will ride on planing surface 22. Except for wave contact, "V" section 16 will be above the surface in planing mode. This structure allows the hull to ride at low trim angles without substantially increasing wetted surface.

Figure 7:
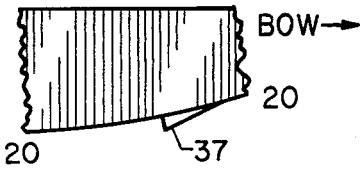
FIGS. 7, 8, 9 and 10 are isolated side elevations of the various spray root deflection configurations of the transition section.

At low trim angles, the spray root may have a tendency to flow up the transition section and thus reduce the efficiency of the hull. In order to prevent this, the transition section may be provided means for spray root deflection. FIGS. 7, 8, 9 and 10 are isolated side elevations of various spray root deflection configurations of the transtion section. In FIG. 7 the spray deflector 37 is a wedge that extends breadthwiseacross the transition section 20. The foreward edge of spray root deflector 37 is tapered into the transition section 20 to reduce resistance. The rear edge of spray root deflector 37 forms a sharp, downwardly extending discontinuity to block the spray root from moving up the transition section. In another embodiment, spray root deflector 37 may be of inflatable construction, such as glued and sewn rubber. When not needed, spray root deflector 37 would be deflected and thus minimalizing its protrusion and resistance. When deflated, such a deflector can also absorb shock.

Figure 8:
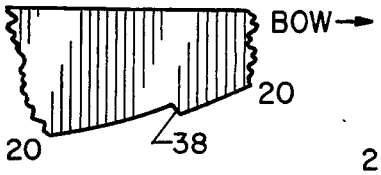

In FIG. 8, spray root deflector 38 blocks the spray root in the same manner as deflector 37. The difference is that deflector 38 is integral to the hull structure. This type of deflector is well suited for molded fiberglass construction.

Figure 9:
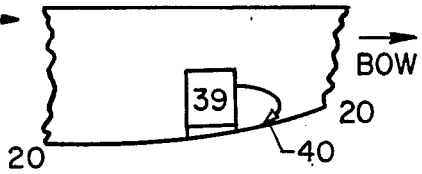
Figure 10:
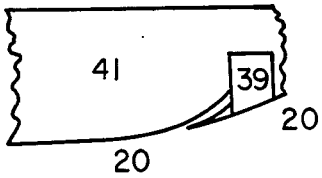

In order to reduce the resistance caused by a discontinuity in the transition, air may be used to force the spray root down. In FIG. 9, transition section 20 is provided with at least one air nozzle 40, but preferrably a series of air nozzles that extends across the transition section. Nozzle 40 blows air at the spray root with air supplied by air source 39. In another embodiment illustrated in FIG. 10, transition 20 is provided with at least one air slot 41. Air slot 41 extends essentially transversly across transition section 20, but may be divided into two or more slots. Air slot 41 extends into the hull and should be angled downward in the direction of the stern to enable it to direct the air from air source 39 at the spray root. Arrows are used to indicate the direction of air flow in FIGS. 9 and 10.

Figure 11:
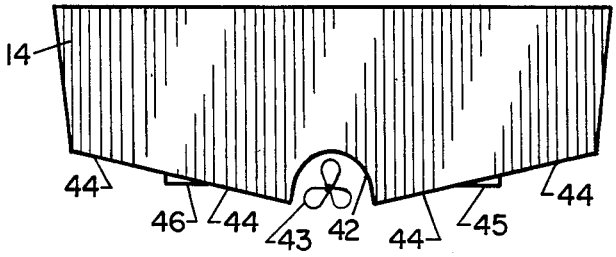
FIG. 11 is a rear elevation view of a hull in accordance with the present invention illustrating a propeller cavity or tunnel.

In another embodiment of the invention, the planing surface is provided with deadrise. A deadrise or V surface is illustrated in FIG. 11. The planing surface need not be completely flat, but may be provided with deadrise as illustrated by planing surface 44. Planing surface 44 may be provided with lifting strakes 45 and 46 to improve performance. Deadrise in the planing surface may require a transition section that is convex in both the longitudinal and transverse directions. The planing surface may also be provided with at least a partial propeller cavity 42 to protect propeller 43 and reduce shaft angle and resistance. The planing surface may be provided with a plurality of propeller cavities 42 as well.

Figure 12:
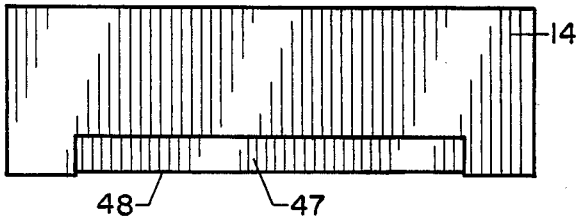
FIG. 12 is a rear elevation view of a hull in accordance with the present invention illustrating an air cavity in the planing surface.

In an air system is uesd, planinng surface 22 may be provided with air cavity 47 and skirt 48, as illustrated in FIG. 12. Stern 14 is provided with skirt 48 to contain air under the planing surface. It understood that downwardly extending members 34 and 36 may be fitted with skirts across the front and back ends to contain air under the planing surface.

Figure 13:
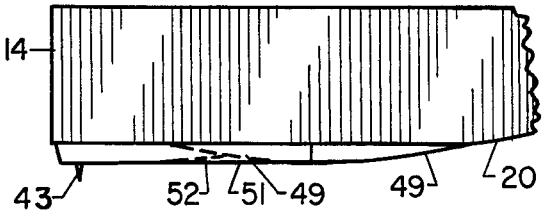
FIG. 13 is a partial side elevation view of a hull in accordance with the present invention illustrating an air blocking system to prevent cavitation of the propeller when operating in conjunction with an air lubrication system.
Figure 14:
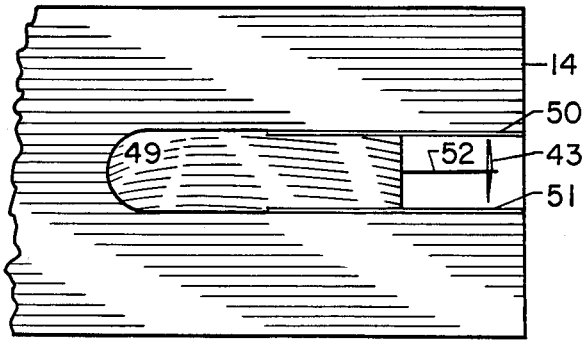
FIG. 14 is a bottom view of a hull in accordance with the present invention and also shows an air blocking system.

For use with air systems, planing surface 22 may be provided air block 49, shown in FIGS. 13 and 14. When planing surface 22 is ventilated or cushioned by air, air block 49 and downwardly extending members 50 and 51 protect propeller 43 from cavitation (ventilation). Air block 49 extends downward from planing surface 22 or from transition section 20 for a portion of its length and then upward for the remainder of its length. Air block 49 is centered with respect to propeller 43, originates foreward of propeller 43, and is at least as wide as propeller 43 at its greatest breadth. The upward slope of air block 49 will draw water to the propeller. When planing surface 22 is riding above the surface on a cushion of air, air block 49 would extend below the surface for at least a portion of its length to prevent air from reaching the porpeller. Downwardly extending members 50 and 51 would also extend below the surface for the same reason. These members extend from air block 49 to at least the rearward face of propeller 43 and are essentially parallel to the the propeller shaft 52. Downwardly extending members 50 and 51 would fair into airblock 49 to prevent air from being channelled to the propeller. This air blocking system can be used in conjuction with propeller cavity 42.

Figure 15:
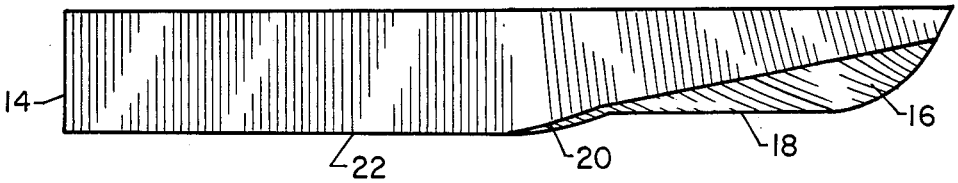
FIG. 15 is a side elevation of a hull in accordance with the present invention illustrating a lower horsepower-to-weight ratio configuration.

To facilitate the use of the convexly down-stepped hull for applications restricted to relatively low horsepower-to-weight ratios, planing surface 22 may be proportionately extended to provide a larger lifting surface. In such a case, planing surface 22 could extend over 50% of the length of the hull 10 and the section showing a "V"-shape 16 could be restricted to one third of the length of the hull 10. This configuration, shown in FIG. 15 can be modified in the same manners as the short planing surface configuration.

Figure 16:
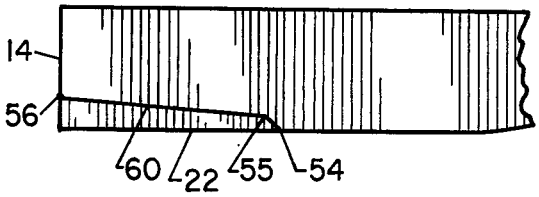
FIG. 16 is a side elevation of a hull in accordance with the present invention illustrating a cut-away planing surface for a fully submerged single screw or surface-piercing twin screw propulsion system.
Figure 17:
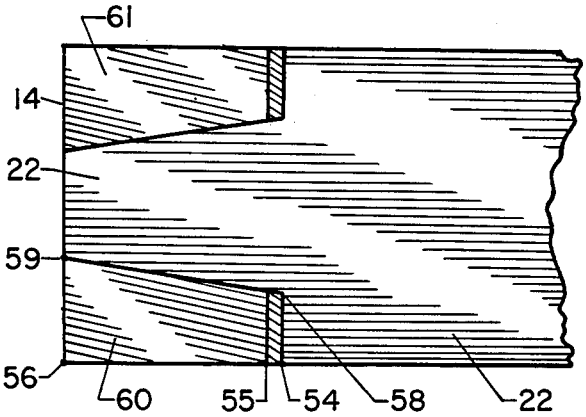
FIG. 17 is a bottom view of FIG. 16.

The planing surface may also use a cut-away configuration as shown in FIGS. 16, 17, 18, 19 and 20. FIG. 16 is a isolated side elevation illustrating a cut-away planing surface for a submerged single-screw propusion system or a surface-piercing twin-screw propulsion system. The cut-away or upwarly displaced portion 60 has outer edge 54, 55, 56. It is preferred that outer edge 54, 55, 56 and upwardly displaced portion 60 slope upwards in the direction of the stern to further prevent water contact on surface 60 and to allow decreased shaft inclination for surface-piercing propulsion systems. FIG. 17 is a bottom view of FIG. 16. Line 54, 58, 59 is the boundary between planing surface 22 and upwardly displaced portion 60. Naturally, there would be an identical upwardly displaced potion 61 on the other side of planing surface 22. In this configuration, two surface-piercing propellers would be mounted under surfaces 60 and 61 or one submerged propeller would be mounted under planing surface 22.

Figure 18:
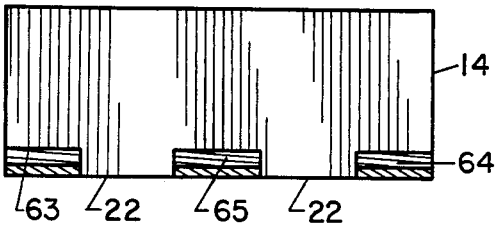
FIG. 18 is a rear elevation of a hull in accordance with the present invention illustrating a cut-away planing surface for a fully submerged twin screw propulsion system.
Figure 19:
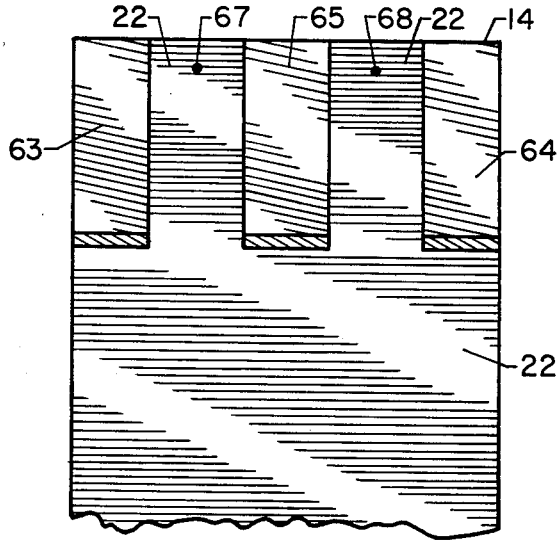
FIG. 19 is a bottom view of FIG. 18.

FIG. 18 is a rear elevation of a hull in accordance with the present invention illustrating a planing surface for a fully submerged, widely spaced, twin screw propulsion system. Surfaces 64, 65 and 66 are upwardly displaced ( the planing surface 22 has been cut away ) and slant upwards in the direction of stern 14 to further prevent water contact. FIG. 19 is a bottom view of FIG. 18. The submerged propellers would be positioned at points 67 and 68, under the planing surface 22 to prevent cavitation. It is understood that a single screw, surface-pirecing propeller could be positioned under upwardly displaced surface 65. Also, the upward displacement of surface 65 could be omitted if the propellers were closer together or if the dimensionless speed of the hull application could not justify this extra cut-out.

Figure 20:
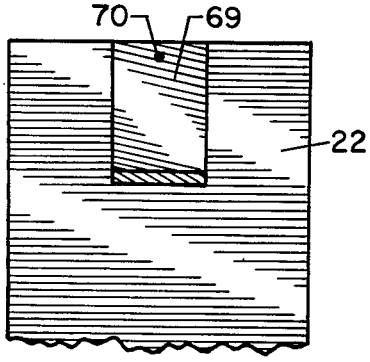
FIG. 20 is a bottom view of a hull in accordance with the present invention illustrating a cut-away planing surface for a surface-piercing single screw propulsion system.

FIG. 20 illustrates the preferred embodiment for a cutaway planing surface for a single screw, surface-piercing propulsion system. In this embodiment, surface 69 is upwardly displaced to form a cut-out of planing surface 22. Obviously the propeller would be located at point 70.

As illustrated by FIGS. 16 through 20, the propulsion system determines the basic shape of the planing surface cut-out. Submerged propellers are placed under the planing surface and surface-piercing propellers under the upwardly displaced section or sections. In the case of tramsom mounted drive units, such as sterndrives or outboards, the propeller would be positioned behind the appropriate surface. The horsepower-to-weight ratio is the main determinate of how much planing surface area is cut-away The only definite rules are that the cut-away sections should not extend beyond 80% of the length of the planing surface and 90% of the width of planing surface. The fist rule is derived from studying a curve of lift per unit area verses percent lenght of planing surface.

It is understood that the various aspects ot the invention may be used in various combinations. It will be obivous to those skilled in the art, that various modifications may be made to the invention describe herein by combining various features disclosed herein. Modifications made to conventional hulls, such as multiple chines, multiple asymetric hulls, blounted convex "V"'s, etc., can also be applied to convexly down-stepped hulls.

In view of the above, the present invention may be embodied in other specific forms without departing from the spirit or essential attributes thereof and, accordingly, reference should be made to the appending claims, rather than to the foregoing specifications as indicating the scope of the invention.

I claim:

1. A hull having sides, chines, a lower section and a lower water-engaging surface, terminated at one end by a bow and at the other end by a stern, said hull showing a "V" shape in cross-section view with the apex of said "V" shape centered with respect to the breadth of said hull extending from said bow along a major portion of the length of said hull, said apex of said V- shaped section being essentially straight along the sternward portion of its length and having more average slope in profile view along the foreward portion of its length relative to said sternward portion of said apex, a substantially planar surface extending essentially the full width of the lower section of said hull, down-stepped from said apex of section showing a "V" shape, and a transition section, convexly shaped, at least in the longitudinal direction, in reference to the exterior of said hull, extending between said chines, having less average slope in cross-section view than said sides at said transition section, and connecting said section showing a "V" shape and said substantially planar surface located on said lower water-engaging surface, wherein said chines originate foreward of said substantially planar surface, above said apex of section showing a "V" shape, and are disposed downward in the direction of said stern along said transition section, extending below said apex of section showing a "V" shape.

2. A hull having sides, chines, a lower section and a lower water-engaging surface, terminated at one end by a bow and at the other end by a stern, said hull showing a "V" shape in cross-section view with the apex of said "V" shape centered with respect to the breadth of said hull extending from said bow along a substantial portion of the length of said hull, said apex of said V- shaped section being essentially straight along the sternward portion of its length and having more average slope in profile view along the foreward portion of its length relative to said sternward portion of said apex, a substantially planar surface extending essentially the full width of the lower section of said hull, down-stepped from said apex of section showing a "V" shape, and a transition section, convexly shaped, at least in the longitudinal direction, in reference to the exterior of said hull, extending between said chines, having less average slope in cross-section view than said sides at said transition section, and connecting said section showing a "V" shape and said substantially planar surface located on said lower water-engaging surface, wherein said chines orignate foreward of said substantially planar surface, above said apex of section showing a "V" shape, and are disposed downward in the direction of said stern along said transition section, extending below said apex of section showing a "V" shape.

3. A hull in accordance with claim 1 or 2 wherein a major portion of the weight is carried over said planar surface.

4. A hull in accordance with claim 1 or 2 wherein said planar surface is provided with atleast one downwardly extending member, said downwardly extending member being subsatntially parallel to the centerline of said hull and being narrow with respect to the breadth of said hull.

5. A hull in accordance with claim 4 wherein said planar surface is provided with a second downwardly extending member, one of said downwardly extending members extending along the left side of said planar surface and the other said downwardly extending member extending along the right side of said planar surface.

6. A hull in accordance with claim 1 or 2 wherein air is forced under said planar surface to provide an air cushion effect.

7. A hull in accordance with claim 6 wherein said planar surface is provided with an air cavity to contain air.

8. A hull in accordance with claim 6 wherein said planing surface is provided with an at least one skirt to contain air.

9. A hull in accordance with claim 6 wherein said planar surface is provided with an air blocking system consisting of an air blocking member that extends downward from said planar surface or said transition section for a portion of its length and then extends upward for the remainder of its length, said air blocking member is centered with respect to a propeller, originates in front of a propeller, being at least as wide as a propeller at its greatest width, and two downwardly extending members that are narrow with respect to the breadth of said hull, said downwardly members extend parallel to a propeller shaft from said air blocking member to at least the rearward face of a propeller, said air blocking member and downwardly extending members being at least partially submerged during air cushion operation mode of said hull.

10. A hull in accordance with claim 1 or 2 wherein said substantially planar surface is provided with deadrise 11. A hull in accordance with claim 10 wherein said substantially planar surface provided with deadrise is provided with lifting strakes.

12. A hull in accordance with claim 1 or 2 wherein said substantially planar surface is provided with at least a partial propeller cavity.

13. A hull in accordance with claim 1 or 2 wherein said transition section is provided with spray root deflection means.

14. A hull in accordance with claim 13 wherein said spray root deflection means is a wedge extending across the breadth of said transition.

15. A hull in accordance with claim 14 wherein said wedge is of inflatable construction.

16. A hull in accordance with claim 13 wherein said spray root deflection means is a sharp discontinuity extending across the breadth of said transition section, said discontinuity being integral to said transition section.

17. A hull in accordance with claim 13 wherein said spray root deflection means is provided by at least one air nozzle and atleast one air source.

18. A hull in accordance with claim 17 wherein said air nozzle or air nozzles are used to ventilate said substantially planar surface.

19. A hull in accordance with claim 13 wherein said spray root deflection means is provided by at least one air slot and at least one air source.

20. A hull in accordance with claim 19 wherein said air slot or air slots are used to ventilate said substantially planar surface.

21. A hull in accordance with claim 1 or 2 wherein a portion or portions of said substantially planar surface is upwardly displaced, said upwardly displaced portion or portions extending from said stern to a length less than eight tenths of the length of said planar surface, having a total maximum width of less than nine tenths of the maximum width of said planar surface and having less total area than said planar surface.

* * * * *